US007410116B2

(12) United States Patent
Planck et al.

(10) Patent No.: US 7,410,116 B2
(45) Date of Patent: Aug. 12, 2008

(54) BOBBIN WINDING SYSTEM

(75) Inventors: Heinrich Planck, Nurtingen (DE); Christoph Riethmuller, Leonberg (DE); Helmut Weinsdorfer, Pliezhausen (DE)

(73) Assignee: DITF Deutsche Institute fur Textil- under Faserforschung, Denkendorf (DE)

( * ) Notice: Subject to any disclaimer, the term of this patent is extended or adjusted under 35 U.S.C. 154(b) by 10 days.

(21) Appl. No.: 11/386,189

(22) Filed: Mar. 22, 2006

(65) Prior Publication Data

US 2006/0169824 A1 Aug. 3, 2006

Related U.S. Application Data

(62) Division of application No. 10/496,274, filed as application No. PCT/EP02/13124 on Nov. 22, 2002, now abandoned.

(30) Foreign Application Priority Data

Nov. 23, 2001 (DE) ..... 101 57 303

(51) Int. Cl.
*B65H 54/28* (2006.01)

(52) U.S. Cl. ..... 242/481; 242/481.3

(58) Field of Classification Search ..... 242/481, 242/481.1, 483.3, 483.4, 481.4, 481.5, 481.3, 242/485.9, 477.1, 477.2, 477.4, 477.5
See application file for complete search history.

(56) References Cited

U.S. PATENT DOCUMENTS

| | | | |
|---|---|---|---|
| 2,461,855 | A | 2/1949 | Tornberg |
| 2,548,523 | A | 4/1951 | Dyer et al. |
| 2,571,694 | A | 10/1951 | Dyer |
| 2,626,765 | A | 1/1953 | Biddison |
| 3,113,737 | A | 12/1963 | Emerson |
| 3,330,492 | A | 7/1967 | Gonsalves |
| 3,693,899 | A | 9/1972 | Burgess et al. |
| 3,860,187 | A | 1/1975 | Liska et al. |
| 3,876,167 | A | 4/1975 | Nittschalk et al. |
| 4,899,529 | A | 2/1990 | Fumio |
| 5,005,776 | A | 4/1991 | Schwarz |

(Continued)

FOREIGN PATENT DOCUMENTS

| | | |
|---|---|---|
| CH | 525828 | 9/1972 |

(Continued)

*Primary Examiner*—Peter M. Cuomo
*Assistant Examiner*—William E Dondero
(74) *Attorney, Agent, or Firm*—Leydig, Voit & Mayer, Ltd.

(57) ABSTRACT

A system for winding a cross-wound bobbin has a rotatably supported tube holder that is intended to receive a tube. The yarn guide element that serves the purpose of shogging the yarn moves in the direction parallel to the axis of rotation of the tube and is made to execute the oscillating reciprocating motion with the aid of a work cylinder. The work cylinder has the advantage that for braking the kinetic energy at the turning point of the yarn guide element, no additional external energy must be applied. It suffices for the applicable cylindrical chamber to be blocked off. Moreover, the gas compressed in the process can be used to accelerate the piston in the opposite direction. The stored braking energy also can be used simultaneously as acceleration energy. Since in the creation of a cross-wound bobbin many thousand such changes of direction occur, the energy savings are substantial.

19 Claims, 4 Drawing Sheets

U.S. PATENT DOCUMENTS

| | | | | |
|---|---|---|---|---|
| 5,209,414 | A | 5/1993 | Clemens et al. | |
| 6,065,712 | A * | 5/2000 | Mayer et al. | 242/477.2 |

FOREIGN PATENT DOCUMENTS

| | | |
|---|---|---|
| GB | 1145264 | 3/1969 |
| JP | 51-88740 | 8/1976 |
| WO | WO 92/08664 | 5/1992 |

* cited by examiner

BOBBIN WINDING SYSTEM

CROSS-REFERENCE TO RELATED APPLICATIONS

This patent application is a divisional of copending U.S. patent application Ser. No. 10/496,274, filed Oct. 4, 2004, which claims priority from International Application No. PCT/EP02/13124, filed Nov. 22, 2002, and German Application No. DE10157303.0, filed Nov. 23, 2001.

FIELD OF THE INVENTION

The present invention relates generally to system for winding bobbins with cross-wound yarn, and more particularly, to a control for more reliably and efficiently controlling movement of the cross-wound bobbin.

BACKGROUND OF THE INVENTION

In the production of yarn, the resultant yarn, in ring spinning, is first wound up in the form of cops. These are small bobbins with a relatively small quantity of yarn. The cops are not suitable for paying out the yarn directly to a yarn-using machine, such as a loom. For that purpose, the yarn must be rewound into a cross-wound bobbin from which the yarn can be drawn off overhead. Drawing the yarn off overhead is necessary since only that assures a high yarn draw-off speed with starting and stopping.

German Patent Disclosure DE 121 963 discloses a bobbin winding system that is suitable for creating cross-wound bobbins. For that purpose, the system has a rotatably supported tube holder onto which the tubes on which the cross winding is created are slipped. For driving the tube or the cross winding formed on it, a roller or cylinder is provided that is oriented axially parallel to the axis of rotation of the tube holder. It is held in contact by frictional engagement with the outside of the particular cross winding formed. To make shogging or movement of the incoming yarn possible, a yarn guide element is provided which can be displaced parallel to the axis of rotation of the tube. The yarn guide element is seated on a cable that travels around three rollers. One of the rollers is driven, while the yarn guide element is moved back and forth between the other two rollers. By means of a microprocessor controller, which with a sensor detects the rpm of the tube holder, the drive motor is controlled such that the desired cross winding is created.

A high edge buildup on the face ends is intended to be avoided by suitable control of the motor and thus of the shogging stroke. The arrangement also is intended to prevent ribbon windings. In ribbon windings, the yarns in the next winding plus one, with the same winding direction, would rest directly on top of one another.

However, it has been demonstrated that the known arrangement requires considerable energy. At the end of the shogging stroke, the motor must be braked, and with the reversed direction of rotation it must be accelerated, leading to increased current consumption.

OBJECTS AND SUMMARY OF THE INVENTION

It is an object of the present invention to provide a bobbin winding system which requires less energy in reversing movement of the bobbin during a winding operation.

In the bobbin winding system of the invention, a tube holder is provided that is rotatably supported about an axis of rotation. A yarn guide element moves parallel to the axis of rotation of the tube holder and is driven with the aid of a work cylinder. A fluid supply device is associated with the work cylinder and is controlled via a control unit. With the aid of the fluid supply device, two cylindrical chambers of the work cylinder are selectively supplied with fluid that is under pressure for moving a piston in an appropriate direction and the yarn guide element along with it. The speed at which the piston moves depends essentially on the inflow speed of the fluid. Braking of the piston is accomplished practically without energy by closure of the venting opening of whichever cylindrical chamber is decreasing in volume in the ongoing shogging stroke.

With the aid of such novel arrangement, high shogging speeds can be chieved. In particular, it is possible to achieve the reversal of motion of the yarn guide element at the face ends of the cross winding very quickly, or in other words in a very short distance.

The arrangement moreover is quite flexible in operation, in the sense that different shogging speeds for the outgoing and the return leg of the shogging stroke can easily be established. The requisite ribbon breaking in the cross winding as well as the axial shifting (jitter) of the reversal point also can be generated in order to avoid the edge buildup.

With the aid of at least one sensor, which functions at least as a digital position sensor, the controller learns that the yarn guide element is located at the position of the sensor. From the successive position measurements and from the knowledge, present in the controller, about the intervening shogging stroke portions, the controller is capable of controlling the supply of fluid to the particular cylindrical chamber in the manner as described above.

By switching the fluid supply to the particular cylindrical chamber on and off accordingly, the current shogging stroke is terminated at the correct point, and the next shogging stroke is started in the opposite direction.

To set the tube, or the particular formed cross winding, into rotation, basically two types of control units can be considered. In one control unit, a cylindrical drive roller is provided, which by suitable means can be maintained in contact by frictional engagement with the outer circumferential surface of the particular cross winding formed. This drive roller is driven by a motor, which can be effectively operated at a constant rpm. However, a variable rpm drive also could be used.

Alternatively, a motor may be coupled directly to the tube holder in a manner fixed against relative rotation. In that case, the motor must have a variable rpm if a constant circumferential speed, and thus, a constant winding speed are to be attained.

Preferably, frequency-regulated alternating current motors or stepping motors can be used in which a desired rpm can be set directly and very precisely, without additional closed control loops for stabilizing the rpm.

If the tube holder is driven directly, that is, without a drive roller contacting the winding, it is possible to readily create both cylindrical and frustoconical cross-wound bobbins. For that purpose, it suffices to execute a more or less shortened shogging stroke from one layer to the next.

For the work cylinder, both work cylinders with piston rods and work cylinders without piston rods can be used. The arrangement with piston rods may be simpler, but may have the disadvantage that depending on the direction of motion, the piston has different effective surface areas. The effective piston surface area is less on the side with the piston rod than on the opposite side, so that for the same fluid pressure, different forces are established. Moreover, the mass to be accelerated and braked is greater, depending on the mass of the piston rod. On the other hand, sealing is relatively simple.

In the work cylinder without a piston rod, conversely, the effective piston surface areas are the same on both sides, and thus the braking and acceleration behavior of the piston is the same, regardless of the direction of motion, for a given fluid pressure. On the other hand, sealing can be more difficult, particularly if compressed air is used as the fluid since a certain amount of leakage can occur.

The fluid supply device may include one multiposition valve per cylindrical chamber, and this multiposition valve has one connection for communication with the particular cylindrical chamber, one connection serving the purpose of venting, and one connection that can be made to communicate with a fluid pressure source. The valve is positioned as close as possible to the particular cylindrical chamber to avoid idle volumes. The avoidance of idle volumes leads to better control and regulation of performance, as well as reducing air consumption. The multiposition valves may be magnetically controlled multiposition valves which are acted upon by the control unit directly.

Instead of using a single position sensor, it also is possible to use a speed sensor that additionally makes it possible to measure the speed. On the basis of its position, the controller thus receives information both with respect to the current position of the piston or yarn guide element and its speed.

It is possible to use two or even more sensors for the position and/or the speed. It will be understood that the sensors would be disposed within the shortest stroke that the yarn guide element executes.

Other objects and advantages of the invention will be come apparent upon reading the following detailed description and upon reference to the drawings, in which:

Figure 1:
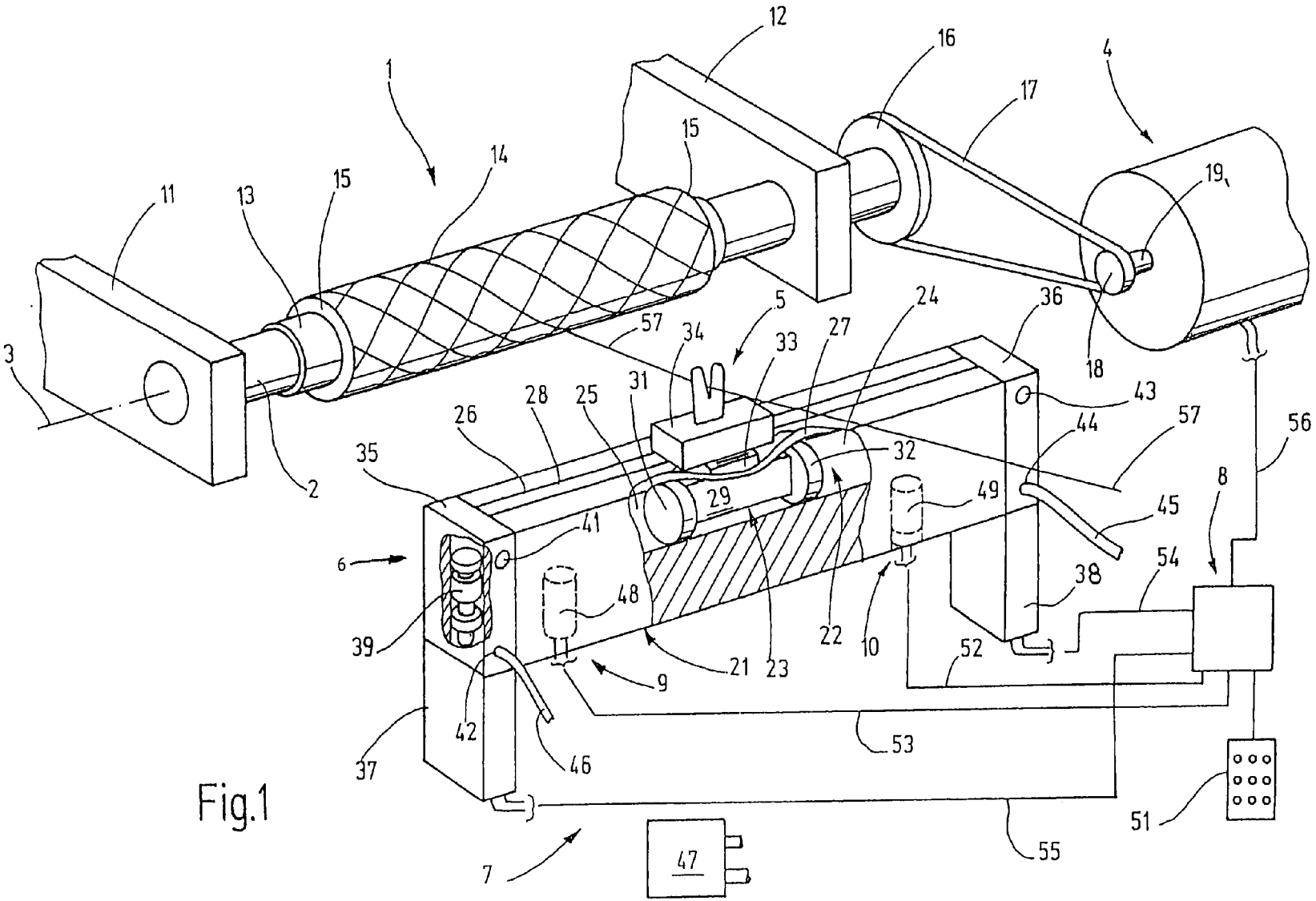
FIG. 1 is a diagrammatic perspective of an illustrative winding machine having a bobbin holder drive in accordance with the invention, in this case having a direct drive for the bobbin holder.

While the invention is susceptible of various modifications and alternative constructions, a certain illustrative embodiments thereof has been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF PREFERRED EMBODIMENTS

Referring now more particularly to FIG. 1 of the drawings, there is shown an illustrative system for winding a cross-wound bobbin 1 The system includes a tube holder 2, which is supported rotatably with respect to an axis of rotation 3; a drive mechanism 4 for the tube holder 2; a yarn guide element 5; a work cylinder 6 for moving the yarn guide element 5; a fluid supply device 7 for the work cylinder 6; and a control unit 8, which cooperates with sensors 9 and 10.

The tube holder 2 essentially comprises a shaft that is rotatably supported between two bearing flanges 11 and 12. On at least one end, the tube holder 2 is releasable from one of the bearing flanges 11 and 12 so that a bobbin tube 13 can be slipped axially onto it. By appropriate means located on or inside the tube holder 2, the bobbin tube 13 can be fixed by frictional engagement on the outer circumferential surface of the tube holder 2. The tube 13 serves as a holder for a cross winding 14 to be built up on it, with the resulting cross-wound bobbin 1 having two face ends 15. While the illustrated bobbin tube 13 is cylindrical, alternatively it could be conically shaped.

On the end of the tube holder 2 that is rotatable in the flange 12 but otherwise is rigidly connected, a pulley 16 is seated on the tube holder 2 in a manner fixed against relative rotation; an endless belt travels over this pulley, and by means of the belt the tube holder 2 is coupled to a drive pulley 18, which in turn is fixed to a motor shaft 19 of the drive motor 4. The drive motor 4 is a motor of controllable rpm, for instance a stepping motor or a frequency-regulated alternating current motor. For extended service life, it preferably is a brushless motor.

The drive motor 4 is regulated such that the tube holder 2 rotates at a speed that leads to a substantially constant circumferential speed of the particular cross winding 14 formed. Accordingly, when the outer diameter of the cross winding 14 is small, the rotational speed is higher, and as the diameter of the cross winding 14 increases, the rotational speed decreases, down to a minimal value when the cross winding 14 is full.

The yarn guide element 5, shown in this case as a simple fork, is movable back and forth essentially parallel to the axis of rotation 3 in front of the cross winding 14 or tube 13. To effect such movement an appropriate work cylinder 6 of a known type, preferably without a piston rod, may be used. The work cylinder 6 in this case has an elongated block-shaped housing 21, which is formed with a cylindrical bore 22. Moving inside the cylindrical bore 22 is a piston 23, which divides the cylindrical bore into two cylindrical chambers 24 and 25. As is usual in work cylinders 6 without a piston rod, the cylindrical bore 22 opens out toward one side in the form of a slot 26 leading to the outside, which is closed off on the inside by a sealing band 27 and on the outside by a guard band 28.

The piston 23 includes a middle piece 29 and two terminal disklike end pieces 31 and 32, which are cylindrical and have a diameter corresponding to the diameter of the cylindrical bore 22. The end pieces 31, 32 form a seal against the wall of the cylindrical bore 22 or against the sealing band 27 in the region of the slot 26 with only little leakage. A slight leakage is harmless. For the sake of the lowest possible energy consumption, the piston 23 should be displaceable in the cylindrical bore 22 as smoothly as possible, and seals at the end pieces can therefore be illuminated.

The end pieces 31, 32 are spaced apart from one another such that the sealing band 27 can be pulled off downwardly and removed from the slot 26 in the region of the middle piece 29. In this region, it passes through a slotlike opening in an extension 33 that protrudes to the outside through the slot 26.

A slider 34 to which the yarn guide element 5 is secured is seated for sliding guided movement on the extension 33 on the top of the work cylinder 6. A similar groove is located in the slider 34 for lifting the guard band 28 so that the extension 33 can be extended to the outside through the gap between the lifted sealing band 27 and the lifted guard band 28. In this way, the piston 23 and the slider 34 are connected mechanically to one another.

Instead of the mechanical connection shown between the yarn guide element 5 and the piston 23 via the extension 33, a magnetic coupling could also be employed. In that case, the cylinder needs no lateral slot 26, or the seals required by such a slot.

A multiposition valve 35, 36, associated with the fluid supply device is flange mounted to each end of the cylindrical housing 21. The two multiposition valves 35, 36 each are provided with a respective electrical drive mechanism 37, 38 by way of which an associated valve spindle 39 is to be moved in a valve chamber. By means of the multiposition valve 35, the cylindrical chamber 25 can be made to communicate selectively with a venting opening 41 or a fluid supply opening 42. In a middle position of the valve spindle 39, the cylindrical chamber 25 is hermetically sealed so that no fluid can escape from the cylindrical chamber 25. It will be understood that the basic construction and operation of such multiposition valves is known and therefore need not be described in further detail.

The multiposition valve 36 has a similar construction. It is provided with both an outlet opening 43 and an inlet opening 44. The inlet openings 42, 44 communicate via lines 45, 46 with a source 47 for fluid under pressure, such as compressed air.

In addition, the two sensors 9, 10 are seated in the cylindrical housing 21 in corresponding bores 48, 49 leading inward from the underside. These sensors serve to detect the position of the piston 23, or its passage past the end pieces 31 and/or 32.

The control of the entire system may be by means of the electronic control unit 8, which preferably is microcontroller-based. It receives-signals from an input keyboard 51 as well as signals from the sensors 9, 10 connected via lines 52, 53. Via lines 54, 55, the central control unit 8 communicates with the electric drive mechanisms 37, 38 of the multiposition valves 35, 36, and it furthermore communicates via a line 56 with the drive motor 4 for controlling the rpm thereof.

The system described thus far functions as follows:

After the flange 12 has been pivoted out of the way, the previously wound, full cross-wound bobbin 1 is pulled off the tube holder 2. Next, a new, empty tube 13 is slipped onto the tube holder 2 and secured there by frictional engagement or other appropriate securing devices. Now a yarn 57, arriving from a yarn supply not otherwise shown, is passed through the yarn guide element 5 and secured to the tube 13 in a suitable way. The yarn 57 comes from a spinning station of a known type, or a yarn package.

Once the system has been prepared to this extent, the user may give the command to start via the control panel 51, whereupon the central controller 8 causes two things to happen simultaneously: It switches on the motor 4 at an rpm that generates the requisite circumferential speed for the smallest winding diameter. Simultaneously, it begins to trigger the multiposition valves 35, 36 in alternating fashion so that the piston 23 executes an oscillating motion in front of the side of the tube 14. The control by the control unit 8 is done in such a way that the speed of the piston 23 and thus of the yarn guide element 5 between the two face ends 15 of the cross winding 14 is substantially constant. The ratio between the circumferential speed of the cross winding 14 and the linear speed of the yarn guide element 5 defines the slope angle that the yarn winding forms on the outer circumferential surface of the cross winding 14.

If it is assumed that the yarn 57 is to be deposited progressively from the left face end 15 to the right face end 15, then the controller 8 puts the multiposition valve 36 in a position in which the right-hand cylindrical chamber 24 communicates fluidically with the venting opening 43. Simultaneously, the control unit 8 keeps the multiposition valve 35 in a position in which a fluidic communication exists between the cylindrical chamber 25 and the fluid source 47. As a result, the fluid or compressed air can flow under pressure into the cylindrical chamber 25 and displace the piston 23 toward the right.

Just before the yarn guide 5 reaches a position in which the yarn 57 arrives at the right-hand face end 15, the control unit 8 switches the multiposition valve 35 into a position in which the cylindrical chamber 25 communicates fluidically with the venting opening 41. As a result, the driving force for the piston 23 is immediately switched off. The kinetic energy of motion still existing and the residual pressure in the cylindrical chamber 25 would cause the piston 23 to continue moving onward by a considerable distance, toward the right, as reviewed in FIG. 1.

To make the braking distance as short as possible, the control unit 8 simultaneously assures that the multiposition valve 36 moves out of the venting position into the blocking position in which the cylindrical chamber 22 communicates fluidically with neither the venting opening 43 nor the venting opening 44. Since this situation ensues just before the end piece 32 on the right reaches the right-hand end of the cylindrical chamber 24 and the gas cushion trapped in it is very small. Even a short motion of the piston 23 will lead to a considerable increase in pressure, which together with the vented cylindrical chamber 25 brakes the piston 23 relatively abruptly. The air compressed in the right-hand cylindrical chamber 24 will begin, after the piston 23 stops, to put the piston 23 into motion in the opposite direction. As soon as the pressure in the cylindrical chamber 24 has dropped below the pressure of the fluid source 47, the control unit 8 moves the multiposition valve 36 into the air supply position. In this position, the fluid source 47 communicates with the cylindrical chamber 24 on the right, via the line 45 and the inlet opening 44. The piston 23 will now move from right to left and accordingly deposit the yarn 57 in a helical line that extends from the right-hand face end 15 to the left-hand face 15.

This valve position is maintained until the piston 25 has moved the yarn guide element 5 into the immediate vicinity of the left-hand face end 15. The control unit 8 will shift the multiposition valve 36 from the air supply position into the venting position and simultaneously shift the multiposition valve 35 into the blocking position. Thus the same process as described above in conjunction with the cylindrical chamber 24 when the piston 23 reaches the right-hand end is repeated on the left-hand end for the cylindrical chamber 25.

As can be seen from the foregoing, the novel system for braking the kinetic energy of the piston 23, which drives the yarn guide element 5 requires no additional energy. The braking is accomplished simply by compression of the air in the applicable cylindrical chamber. The compressed air can simultaneously be used as an energy storing means for accelerating the piston in the opposite direction. In each case, the braking energy employed for compressing the gas upon braking can be recovered upon acceleration. Braking the kinetic energy with the least possible amount of energy is significant when cross-wound bobbins are being formed since one braking event and one acceleration event each occur per layer of the cross-wound bobbin, and one cross-wound bobbin has several tens of thousands of layers.

By regulating the pressure source 47 or the inflow speed of the fluid into the cylindrical chambers 24, 25, for instance by means of appropriate additional flow valves, not shown, or by proportionately adjusting the multiposition valves on the inlet side, the speed at which the piston 23 moves within the constant speed range can be adjusted. It is possible as a result to determine the angle that the windings form on the cross winding 15 within wide limits. It is readily possible to produce various angles, for instance with the angle upon deposition of the yarn 57 being less when the yarn is wound on from the left-hand face end 15 to the right-hand face end 15 than in the opposite winding direction. Instead of regulation on the inlet side, regulation on the outlet side by the multiposition valves or additional proportional valves also may be employed.

By slight variations in the stroke that the yarn guide element 5 executes, so-called ribbon breaking actions and a scattering of the reversal points (edge shifting) on the two face ends 15 can be brought about. The ribbon breaking actions prevent the yarn in the respective next windings plus one from being deposited exactly congruently with the next winding plus one located underneath. Such congruent winding would reduce the quantity of yarn to be applied for the same winding diameter. The jitter in the region of the face ends of the wound yarn prevents the reversal points from being located congruently one above the other which would cause a high edge buildup. By adjusting the rpm of the motor 4, the slope angle can also be varied.

The "approach" of the yarn guide element 5 toward the applicable face end 15 is detected with the aid of the two sensors 9, 10, which measure the travel past the adjacent end piece 31 or 32. The spacing between the two sensors 9, 10 is selected such to be less than the least distance travelled in operation by the yarn guide element parallel to the axis of rotation 3.

Because of the geometric ratios between the sensors 9, 10 and the two end pieces 31, 32, the control unit 8 can measure the speed at which the piston 23 moves from left to right since the last passage, for instance by the end piece 32 at the sensor 9 until the first passage past the sensor 10. From this speed of motion in conjunction with the location of the sensor 10, the controller 8 can estimate how long it will take until the piston 23 has transported the yarn 57 as far as the right-hand face end 15 and the above-described reversal of the valves 35, 36 must take place. For the opposite direction, the same logically applies.

In addition, from the transit time of the arrangement in conjunction with the yarn thickness, which is input for instance via the keyboard 51, and the slope angles input via the keyboard, the controller 8 knows the diameter of the cross winding 14 that has meanwhile been attained since the beginning of winding and can accordingly, without sensors for the winding diameter, either readjust the drive motor 4 and/or vary the speed of motion of the piston 23.

Figure 2:
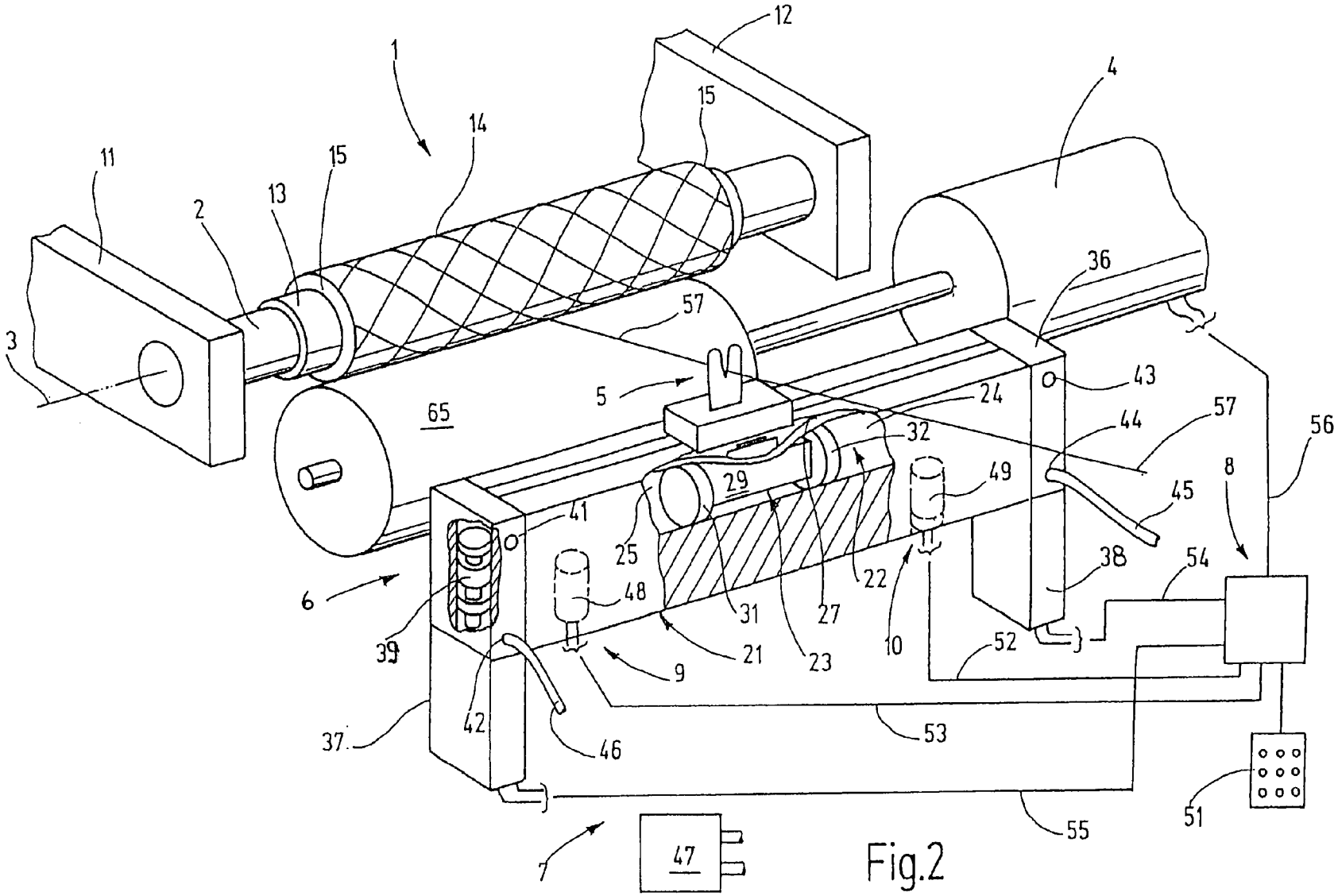
FIG. 2 is a perspective of an alternative embodiment of winding machine in accordance with the invention having a friction roller operated drive.

FIG. 2 shows an embodiment which differs from the embodiment of FIG. 1 in the manner in which the tube 13 is set into rotation. While in the embodiment of FIG. 1 the tube holder 2 is driven directly by the motor 4, in the exemplary embodiment of FIG. 2 a friction roller 65 is provided, supported so as to be rotatable axially parallel to the axis of rotation 3. The elements for supporting the friction roller 65 are not shown individually and are well known in the art.

The friction roller 65 is driven directly by the motor 4. With the aid of its bearing device, it is assured that the friction roller 65, whose length is equivalent to the greatest axial length of the cross winding 14, is held in contact by frictional engagement with the outer circumferential surface of the cross winding formed at the time. In this way, a constant circumferential speed is necessarily generated when the motor 4 drives the friction roller 65 at a constant rpm.

Figure 3:
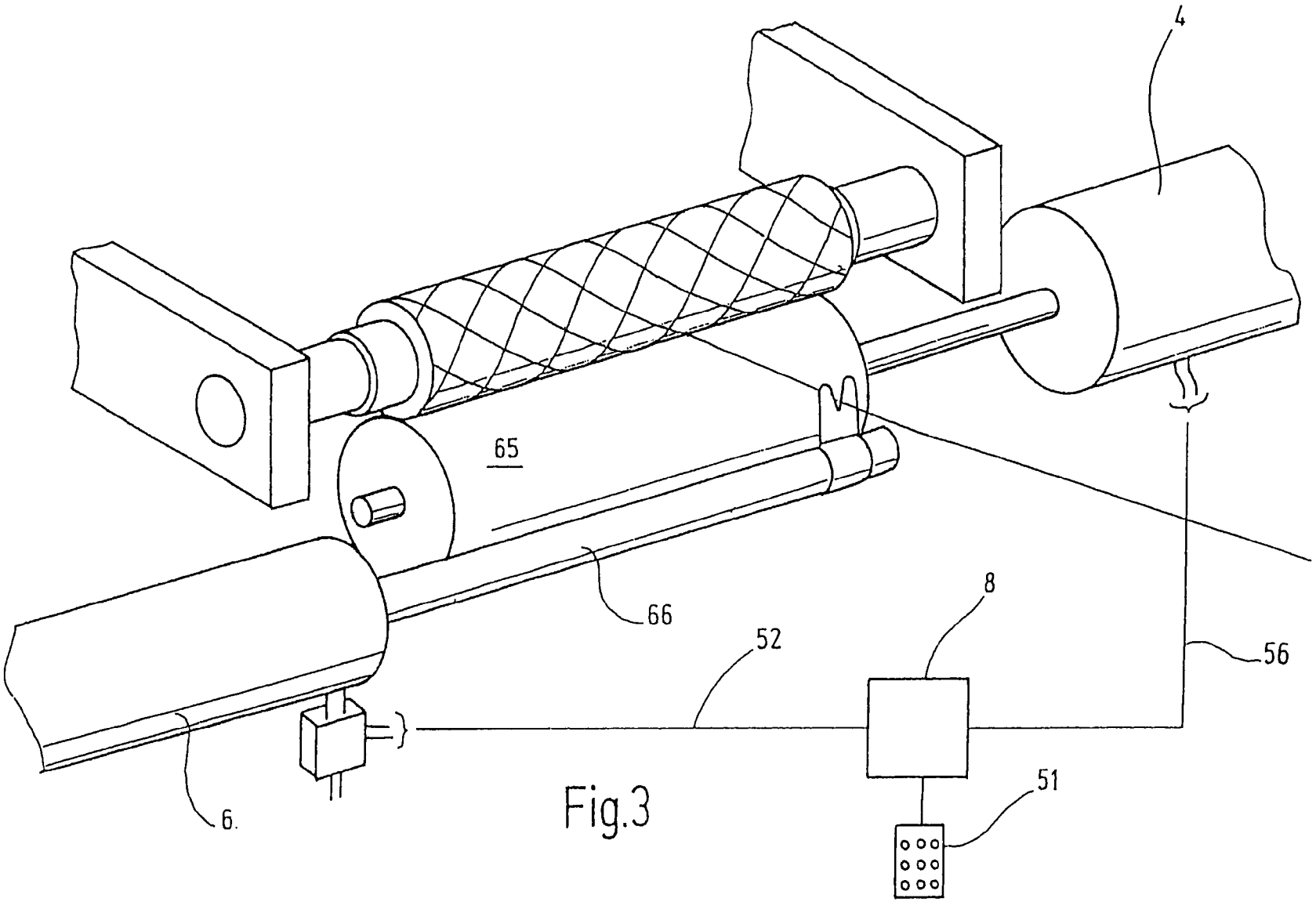
FIG. 3 is a perspective of still a further alternative embodiment of winding system with a work cylinder having a piston rod.

FIG. 3 finally shows an embodiment of the invention in which, instead of the work cylinder 6 without a piston rod, shown in FIGS. 1 and 2, a work cylinder 6 with a piston rod 66 is used. Otherwise, the mode of operation is as explained above in conjunction with FIG. 1, taking only the different operative diameters of the piston into account.

Figure 4:
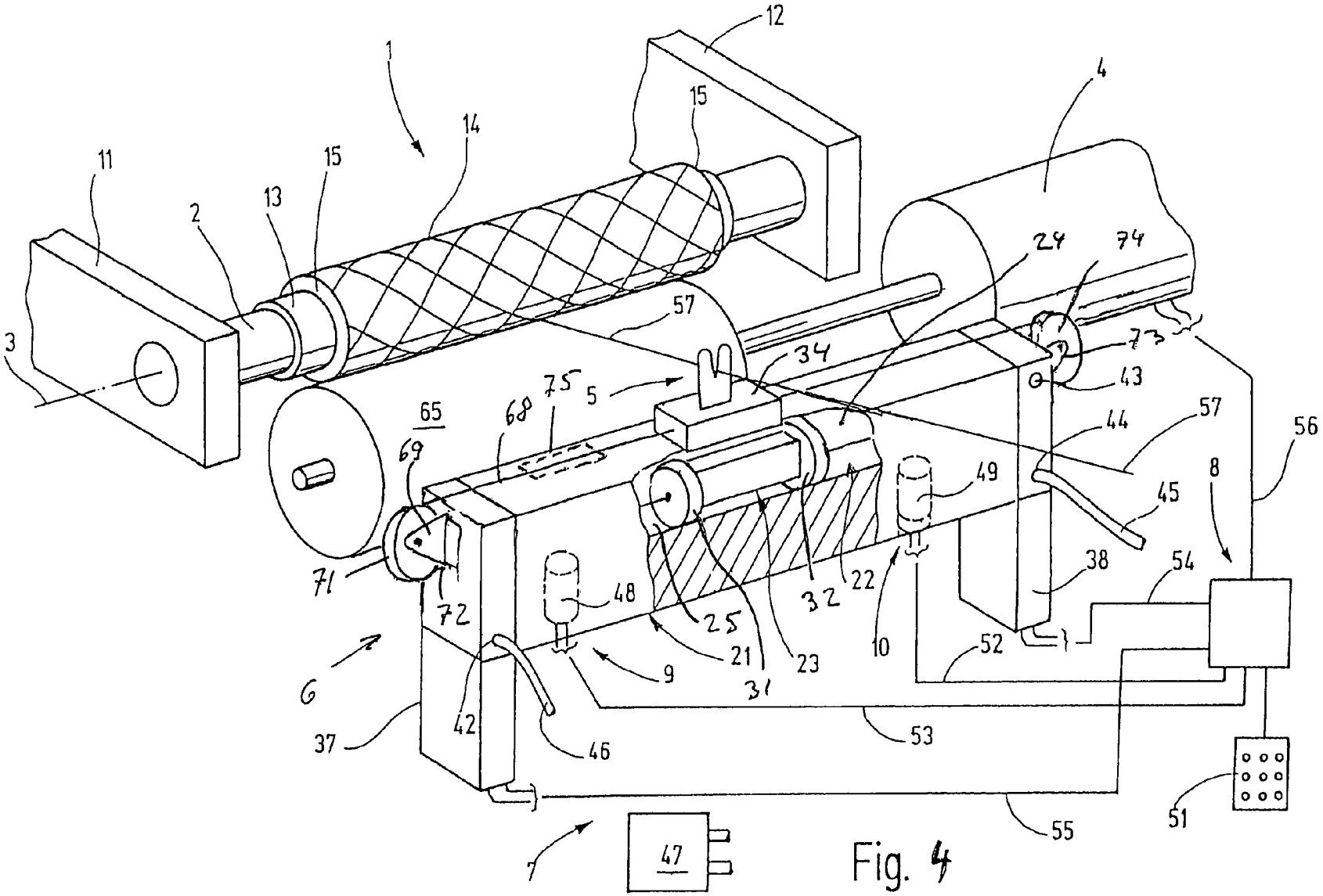
FIG. 4 is a perspective of still another alternative embodiment of winding system in accordance with the invention having a cable operated work cylinder.

In FIG. 4, an exemplary embodiment of the system of the invention is again shown in which the work cylinder 6 does not have a piston rod. The connection between the piston 23 and the slider 34 is made by a very flexible member in the form of a cable 68. The slider 34 travels freely displaceably on the smooth top side of the work cylinder 6.

The cable 68 is secured to the face end of the slider 34 toward the observer and from there travels in the direction of the left-hand face end of the work cylinder 6. A deflection roller 71 is rotatably supported on the outside of the work cylinder 6 on the face end by a bearing block 69. The cable 68 travels around this deflection roller 71. Below the deflection roller 71, the cable passes through a bore 72 into the cylindrical chamber 25, inside in which it is connected to the end piece 31. Inside the cylindrical chamber 25, the cable 68 extends coaxially to the chamber and at the top extends parallel to the flat top side of the work cylinder 6.

Another segment of the cable 68 leads from the face end of the slider 34 remote from the observer in the direction of the right-hand face end of the work cylinder 6. Here, a deflection roller 74 is supported, again loosely rotatably, with the aid of a further bearing block 73. The applicable segment of the cable 68 travels around the deflection roller 74, and on the underside of the deflection roller 74 it passes through a bore, not visible, into the cylindrical chamber 24. Inside the cylindrical chamber 24, the applicable segment of the cable 68 is connected to the end piece 32 of the piston 28. The cable 68 can be kept taut by appropriate spring members.

Upon leftward motion of the piston 23, the slider 34 moves with the yarn guide 5 along the top side of the work cylinder 6 into the correct terminal position, and vice versa. The motion of the slider 34 is automatically coupled with the motion of the piston 23, but in phase opposition.

The arrangement shown in FIG. 4 functions dynamically, in the sense that the piston 23 is intrinsically constantly in motion during the winding operation. There is accordingly no necessity to seal off the cylindrical chambers 24, 25 hermetically from the ambient atmosphere. It accordingly suffices if the cable 68, which is for instance a monofilament, passes through the bore 72, or the corresponding bore on the other face end of the work cylinder 6, without any special sealing. Leak-free sealing is not required. It suffices for the cable 68, together with the bore, to generate throttling with an adequate throttling action. For the same of minimizing energy consumption of the arrangement, conversely, it is important to keep the friction of the entire system as low as possible; besides, otherwise there would be the risk that, because of the enormously high number of motions, a seal would be soon damaged by the cable 68 in any event.

The advantage of the arrangement of FIG. 4 is the same as for the arrangement of FIGS. 1 and 2. The mass of the moving parts is kept very low, thus reducing the expenditure of energy for braking and acceleration. A further advantage of the arrangement of FIG. 4 resides in the avoidance of complicated sealing bands on the work cylinder 6. The structural design is markedly simpler.

Instead of a cable for coupling the slider 34 to the piston 23, a thin band, such as a steel band also could be used, such as shown in dashed lines at 75. The advantage of the band over the cable is the lesser thickness for the same surface area, so that the bending forces upon deflection over the rollers 71, 74 are kept slight. The service life can be increased markedly under some circumstances.

From the foregoing, it can be seen that a system is provided for winding a cross-wound bobbin onto a rotatable tube supported on a tool holder. A yarn guide element that serves the purpose of shogging moves in a direction parallel to the axis of rotation of the tube and is made to execute the oscillating reciprocating motion with the aid of a work cylinder. The work cylinder has the advantage that in braking the kinetic energy at the turning or reversal point of the yarn guide element, no additional external energy must be used. It suffices for the applicable cylindrical chamber to be blocked off. Moreover, the gas compressed in the process can be used to accelerate movement of the piston in the reverse direction. The stored braking energy can also be used simultaneously as acceleration energy. Since in the creation of a cross-wound bobbin many thousand such changes of direction occur, the energy savings are substantial.

What is claimed is:

1. A system for winding cross-wound bobbins (1) with cross windings (14) having two face ends (15) comprising a tube holder (2) rotatably supported for movement about an axis of rotation (3), a cross-wound bobbin tube (13) adapted for removable positioning onto said tube holder (2) for rotation with the tube holder;

a drive mechanism (4) for rotating the tube (13) in order to wind up a yarn (59) onto the tube (13);

a yarn guide element (5) mounted for movement back and forth in a longitudinal direction of the cross winding (14) and tube (3) in order to shog the yarn (59) during the winding process so as to form a cross winding (14) on the tube (13);

a rodless work cylinder (6) having a cylindrical space (22) between opposed end faces with a piston (23) that divides the cylindrical space into first and second cylindrical chambers (24, 25), one of said cylinder end faces being formed with a bore (72), a cable (68, 75) extending through said cylinder end face bore and coupled between said piston (23) and said yarn guide element (5);

a controllable fluid supply device (7) which selectively communicates with the chambers (24, 25) in order to selectively supply fluid under pressure to at least one of the cylindrical chambers (24, 25) or to vent at least one of the cylindrical chambers such that the piston (23) is moved with the requisite longitudinal motions for causing said cable to move said guide element (5); and a control unit (8) for controlling the fluid supply device (7) such that the piston (23) is moved with the requisite motion for the rotating tube (13) or cross winding (14) for effecting the desired movement of the yarn guide element (5) by means of the connecting cable (68,75).

2. The system of claim 1 in which said tube (13) has a cylinder shape.

3. The system of claim 1 in which said drive mechanism (14) includes a rotatable drive roller (65) held in frictional engagement with an outer circumference of a cross winding (14) formed on the tube (3), and a motor for driving the drive roller.

4. The system of claim 3 in which said motor (4) is operable at a constant rpm.

5. The system of claim 1 in which said drive mechanism (4) includes an adjustable-speed electric motor (4) coupled for directly driving the tube holder (13).

6. The system of claim 1 in which said drive motor (4)is a frequency-regulated alternating current motor.

7. The system of claim 6 in the said control unit (8) controls operation of the motor (4) such that the circumferential speed of a particular cross winding (14) formed on the tube (13) is substantially independent of the winding diameter.

8. The system of claim 1 in which said drive motor (4) is a stepping motor.

9. The system of claim 1 in which said fluid supply device (7) includes at least one multi-position valve (36, 37) operatively coupled to each cylinder chamber (24, 25), said multi-position valves (36, 37) each including one connection communicating with a respective cylindrical chamber (24, 25), one connection (43, 44) communicating with a fluid pressure source, and one venting connection (41, 42).

10. The system of claim 9 in which each said multiposition valves (35, 36) is an electrically controlled multiposition valve.

11. The system of claim 9 including at least one sensor (9, 10) electrically coupled to the control unit and operable for detecting at least one position of the yarn guide elements.

12. The system of claim 11 in which said sensor (9, 10) operatively operates with the piston (23) of the work cylinder (6).

13. The system of claim 9 in which said sensor (9, 10) is a speed sensor.

14. The system of claim 9 including at least two sensors (9, 10) located within the course of movement of face ends of a cross winding (14) formed on the tube.

15. The system of claim 9 in which the control unit (8) is operable for controlling the work cylinder (6) to prevent ribbon windings and/or a high edge buildup at the face ends of the cross-wound winding.

16. The system of claim 1 including a sensor for detecting the diameter of the cross winding (14) at least one point.

17. The system of claim 1 in which said cable has a round cross section.

18. The system of claim 1 in which said cable is a band (75) with a flat cross section.

19. The system of claim 1 in which said cable is movable relative to said end face bore without an auxiliary sealing member between the bore and cable.

* * * * *